US009682564B2

(12) United States Patent
Saeki et al.

(10) Patent No.: US 9,682,564 B2
(45) Date of Patent: Jun. 20, 2017

(54) PRINTING APPARATUS

(71) Applicant: CANON KABUSHIKI KAISHA, Tokyo (JP)

(72) Inventors: Tsuyoshi Saeki, Kawasaki (JP); Noboru Shimoyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/153,388

(22) Filed: May 12, 2016

(65) Prior Publication Data

US 2016/0347071 A1 Dec. 1, 2016

(30) Foreign Application Priority Data

May 29, 2015 (JP) ..... 2015-110807

(51) Int. Cl.
*B41J 2/175* (2006.01)
*B41J 2/19* (2006.01)
*B41J 29/02* (2006.01)

(52) U.S. Cl.
CPC ..... *B41J 2/175* (2013.01); *B41J 2/17503* (2013.01); *B41J 2/17506* (2013.01); *B41J 2/17513* (2013.01); *B41J 2/17566* (2013.01); *B41J 2/19* (2013.01); *B41J 29/02* (2013.01); *B41J 2002/17579* (2013.01)

(58) Field of Classification Search
CPC .... B41J 2/175; B41J 2/17503; B41J 2/17506; B41J 2/17509; B41J 2/17513; B41J 2/1752; B41J 2/17523; B41J 2/17559; B41J 2/17566; B41J 2002/17579
See application file for complete search history.

(56) References Cited

U.S. PATENT DOCUMENTS 6,209,980 B1 * 4/2001 Kobayashi ..... B41J 2/17513 347/7
6,846,072 B2 * 1/2005 Sato ..... B41J 3/445 347/86
7,594,717 B2 * 9/2009 Sheinman ..... B41J 2/175 347/89
8,602,513 B2 * 12/2013 Ara ..... B41J 2/17509 347/7

FOREIGN PATENT DOCUMENTS

JP 2007-237552 9/2007

* cited by examiner

*Primary Examiner* — Ahn T. N. Vo
(74) *Attorney, Agent, or Firm* — Fitzpatrick Cella Harper & Scinto

(57) ABSTRACT

A printing apparatus according to the present invention includes a storage chamber, a first communicating portion through which an ink tank communicates with the storage chamber, a second communicating portion through which a printhead is communicates with the storage chamber, and side walls arranged facing each other so as to form a channel in which ink flows from a side of the first communicating portion to a side of the second communicating portion in the storage chamber. The storage chamber includes a first space, and a second space located closer to the side of the second communicating portion than the first space, in which a distance between the side walls is set larger than in the first space. The apparatus includes a detecting unit arranged in the second space and detecting a liquid surface of ink.

19 Claims, 11 Drawing Sheets

PRINTING APPARATUS

BACKGROUND OF THE INVENTION

Field of the Invention

The present invention relates to a printing apparatus for performing printing by liquid ink.

Description of the Related Art

There is known an inkjet printing apparatus that includes a sub-tank capable of temporarily storing ink in a channel from an ink tank to a printhead to improve the consumption properties of ink in an ink tank or prevent ink from running out during a printing operation. Even if ink in the ink tank that is a main tank runs out during a printing operation, this printing apparatus can continue the printing operation by using ink in the sub-tank. The remaining ink amount in the main tank can be determined by detecting the remaining ink amount in the sub-tank. To detect the remaining ink amount in a tank, there is generally known a method of detecting the liquid surface height of ink. As such methods, an electrode method and an optical method are known. The electrode method is a method of detecting the liquid surface height of ink based on the electrically connected state between two electrode pins provided in a tank. The optical method is a method of detecting the liquid surface height of ink based on the reflection state of a light beam by a photosensor and a prism.

On the other hand, as a method of supplying ink from the main tank to the printhead via the sub-tank, a method using an ink water head difference is known. If ink is discharged from the nozzles of the printhead by a printing operation or suction operation in a state in which the channel is filled with the ink, air as much as the ink supplied to the printhead flows from an air vent into the main tank. If the ink in the main tank runs out, the ink in the sub-tank is consumed. At this time, bubbles remaining in the main tank or ink channel flow into the sub-tank.

The bubbles may affect detection of the liquid surface height of ink. For example, in the electrode method, when bubbles come into contact with the electrodes, the electrically connected state may be maintained even if the liquid surface lowers, and correct detection may be impossible. In the optical method as well, if bubbles adhere to the prism surface, the light beam may be reflected irrespective of the presence/absence of a liquid, and correct detection may be impossible.

Japanese Patent Laid-Open No. 2007-237552 discloses a structure that divides a sub-tank open to air into two chambers by a partition. The two chambers communicate on the upper and lower sides of the partition. Air can be distributed on the upper side, and ink can be distributed on the lower side. The detecting position of the sensor of the optical method is set in one chamber. The partition traps bubbles, thereby preventing the bubbles from entering the chamber in which the detecting position of the sensor of the optical method is set.

However, the structure of the sub-tank of Japanese Patent Laid-Open No. 2007-237552 is a structure with an air vent. In a sub-tank without an air vent, even if the partition of Japanese Patent Laid-Open No. 2007-237552 is provided, when the liquid surfaces in the two chambers lower, bubbles as much as the lowering of the liquid surfaces are brought into the chamber in which the detecting position of the sensor is set.

SUMMARY OF THE INVENTION

The present invention provides a technique of suppressing an ink liquid surface detection error irrespective of the presence/absence of an air vent.

According to an aspect of the present invention, there is provided a printing apparatus comprising: a printhead; a storage chamber configured to store ink to be supplied to the printhead; a first communicating portion through which an ink tank attached to the printing apparatus is capable of communicating with the storage chamber; a second communicating portion through which the printhead is capable of communicating with the storage chamber; and a first side wall and a second side wall arranged facing each other so as to form a channel in which ink flows from a side of the first communicating portion to a side of the second communicating portion in the storage chamber, wherein the storage chamber includes a first space, and a second space located closer to the side of the second communicating portion than the first space, in which a distance between the first side wall and the second side wall is set larger than in the first space, and the printing apparatus further comprises a detecting unit arranged in the second space and capable of detecting a liquid surface of ink in the storage chamber.

Further features of the present invention will become apparent from the following description of exemplary embodiments (with reference to the attached drawings).

DESCRIPTION OF THE EMBODIMENTS

<First Embodiment>

Figure 1:
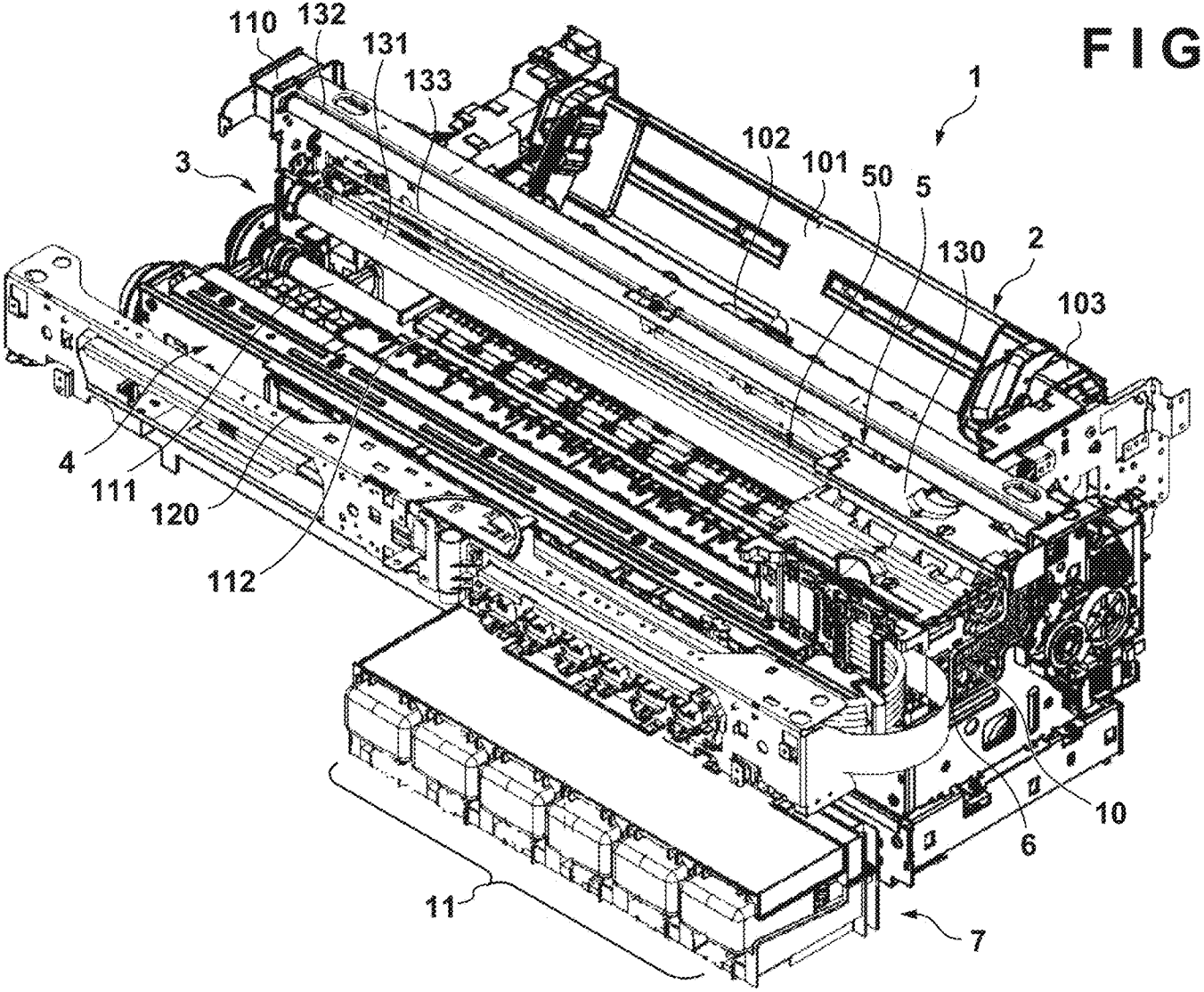
FIG. 1 is a schematic view of a printing apparatus according to an embodiment of the present invention.

FIG. 1 is a schematic view of a printing apparatus 1 according to an embodiment of the present invention. In this embodiment, a case in which the present invention is applied to a serial-type inkjet printing apparatus will be described. However, the present invention is also applicable to an inkjet printing apparatus of another type.

Note that "print" not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans. Additionally, in this embodiment, "printing medium" is assumed to be a paper sheet, but may be cloth, a plastic film, or the like.

The printing apparatus 1 is roughly divided into a feeding unit 2, a conveying unit 3, a discharging unit 4, a printing unit 5, a recovery unit 6, and an ink supply unit 7 by functions. The feeding unit 2, the conveying unit 3, and the discharging unit 4 are mechanisms configured to convey a printing medium. The conveyance direction will sometimes be referred to as a sub-scanning direction, and a direction perpendicular to the sub-scanning direction will sometimes be referred to as a main scanning direction. The printing unit 5 is a mechanism configured to discharge ink to a printing medium and form an image. The mechanical units will be described below.

The feeding unit 2 includes a pressing plate 101 on which printing media are stacked, a feed roller 102 that feeds the printing media one by one, a separation unit (not shown) that separates a printing medium, and a base 103 on which these components are mounted. A printing medium stacked on the pressing plate 101 is fed to the conveying unit 3 by the rotation of the feed roller 102 that is rotationally driven. The separation unit is, for example, a separation roller pressed against the feed roller 102, which prevents erroneous multiple conveyance of the printing media conveyed by the feed roller 102.

The conveying unit 3 includes a conveyance roller 111 extending in the main scanning direction, and a plurality of pinch rollers 112 arranged in the main scanning direction. The conveyance roller 111 is rotationally driven, and the plurality of pinch rollers 112 are pressed against the conveyance roller 111 and rotated. The printing medium fed from the feeding unit 2 is nipped by the nip portions between the conveyance roller 111 and the plurality of pinch rollers 112 and conveyed in the sub-scanning direction to the printing unit 5.

The discharging unit 4 includes a discharge roller 120 extending in the main scanning direction, and a plurality of spurs (not shown) arranged in the main scanning direction. The discharge roller 120 is rotationally driven, and the plurality of spurs are pressed against the discharge roller 120 and rotated. The printing medium conveyed from the conveying unit 3 is conveyed in the sub-scanning direction by the rotation of the discharge roller 120.

The printing unit 5 includes a printhead 10, a carriage 130, and a driving mechanism 50. The printhead 10 discharges ink to the printing medium conveyed by the conveying unit 3 and forms an image. The printhead 10 is mounted on the carriage 130. The driving mechanism 50 is a mechanism configured to reciprocally move the carriage 130 in the main scanning direction. In this embodiment, the driving mechanism 50 includes a guide rail 131 extending in the main scanning direction, and a belt transmission mechanism 132. The guide rail 131 engages with the carriage 130 and guides the movement to the carriage 130 in the main scanning direction. The belt transmission mechanism 132 includes an endless belt that travels in the main scanning direction. Part of the endless belt is fixed to the carriage 130. The belt transmission mechanism 132 includes a carriage motor (not shown). By the driving force of the carriage motor, the endless belt travels, and the carriage 130 moves.

Image printing on a printing medium can be performed, for example, in the following way. When printing an image on a printing medium, the conveyance roller 111 is driven to convey the printing medium to a row position (a printing position in the sub-scanning direction) at which an image is to be formed. Next, the carriage 130 is moved to a printing position in the main scanning direction, and the printhead 10 discharges ink to form an image. This operation is repeated subsequently, thereby printing an image. That is, when printing an image on a printing medium, the conveyance roller 111 intermittently conveys the printing medium, and the printing unit 5 prints an image during a stop of printing medium conveyance by the conveyance roller 111.

The recovery unit 6 is used to recover and maintain the ink discharge performance of the printhead 10, and is arranged at an end of the printing apparatus 1 within the moving range of the carriage 130. FIG. 1 illustrates a state in which the printhead 10 is located on the recovery unit 6. The recovery unit 6 includes a cap unit (not shown). The cap unit caps the ink discharge surface of the printhead 10 to suppress nozzle drying. In addition, the recovery unit 6 includes a suction pump (not shown), and sucks the ink from the nozzles of the printhead 10 via the cap unit. The recovery unit 6 also includes a wiper (not shown) that wipes and cleans the ink discharge surface of the printhead 10.

The ink supply unit 7 forms a supply channel configured to supply ink from each of a plurality of ink tanks 11 storing ink to the printhead 10. As a method of supplying inks from the ink tanks 11 to the printhead 10, a method using an ink water head difference is employed. Each ink tank 11 is detachably attached to the printing apparatus 1 and is exchangeable.

Figure 2:
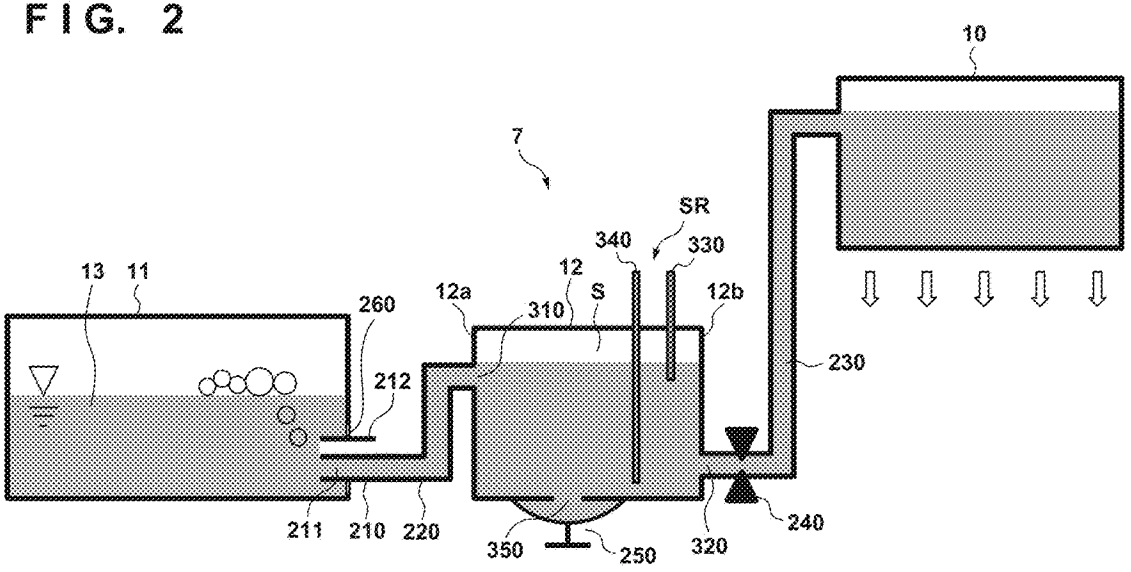
FIG. 2 is an explanatory view of an ink supply unit of the printing apparatus shown in FIG. 1.
Figure 3:
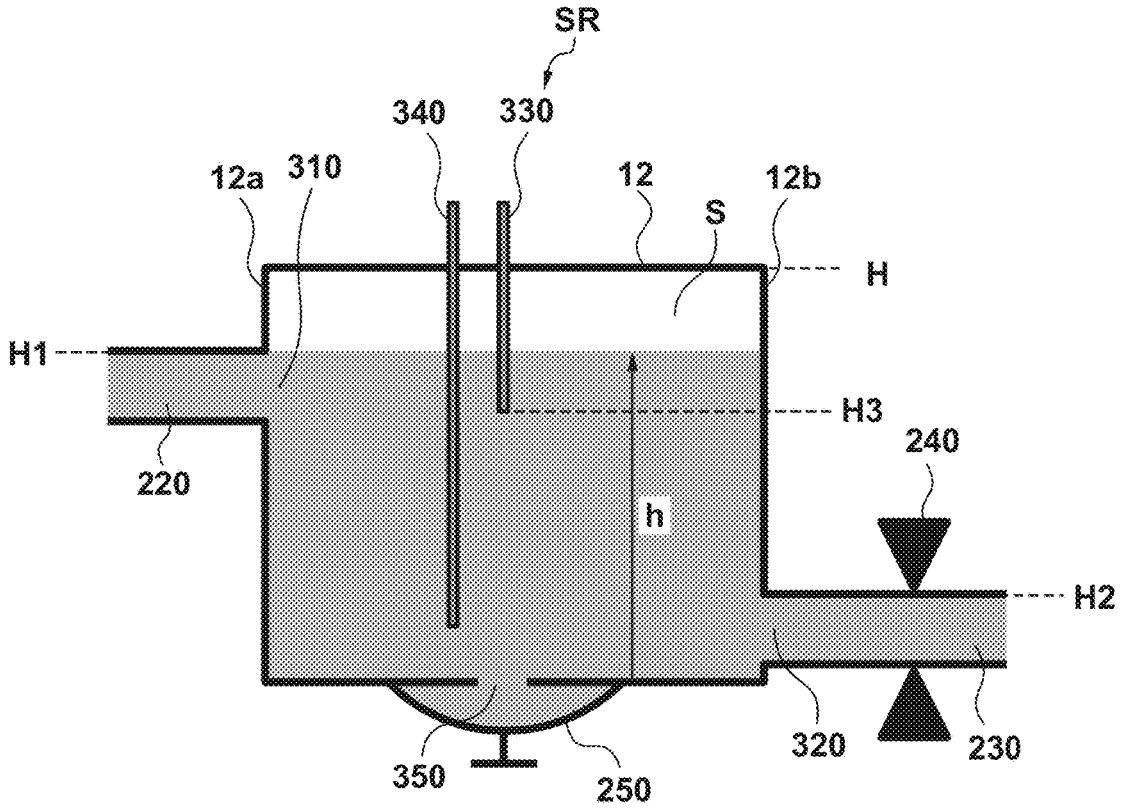
FIG. 3 is an explanatory view of a sub-tank.

FIG. 2 is an explanatory view of the ink supply unit 7. The ink supply unit 7 includes a storage unit 12 provided for each ink tank 11. The storage unit 12 is a buffer tank that forms a storage chamber S configured to temporarily store ink to be supplied to the printhead. The storage unit 12 is fixed to the printing apparatus 1. The ink tank 11 will sometimes be referred to as the main tank 11, and the storage unit 12 will sometimes be referred to as the sub-tank 12 in the following explanation. FIG. 3 is an explanatory view of the sub-tank 12. A description will be made below with reference to FIGS. 2 and 3.

Each main tank 11 and the corresponding sub-tank 12 are connected via a needle 210 and a pipe 220. The needle 210 and the pipe 220 form an ink supply channel that enables ink distribution between the main tank 11 and the sub-tank 12.

The needle 210 is inserted into the main tank 11 when the main tank 11 is attached to the printing apparatus 1. The inner surface of a seal member 260 of the main tank 11 adheres to the outer surface of the needle 210, thereby forming a seal state. The needle 210 includes a pipe 211 that communicates with the interior of the main tank 11 and is connected to the pipe 220, and an air vent 212 that makes the interior of the main tank 11 communicate with the atmosphere.

In this embodiment, the storage chamber S has no air vent. For this reason, when ink is discharged from the printhead 10 by a printing operation or the suction operation of the recovery unit 6, ink as much as the discharged amount is supplied from the side of the main tank 11 to the printhead 10. In addition, air as much as the amount of ink supplied to the printhead 10 flows from the air vent 212 to the main tank 11.

The sub-tank 12 includes one end 12*a* and the other end 12*b*. The sub-tank 12 is provided with a communicating portion 310 located on one end side, and is also provided with a communicating portion 320 located on the other end side. The communicating portions 310 and 320 are openings. The pipe 220 is connected to the communicating portion 310 to make the storage chamber S communicate with the main tank 11. A pipe 230 is connected to the communicating portion 320, and the storage chamber S and the printhead 10 can communicate with via the pipe 230. The pipe 230 forms an ink supply channel and is partially formed from, for example, a flexible tube. When supplying ink from the main tank 11 to the printhead 10 via the sub-tank 12, the one end 12*a* is the upstream end in the ink flow direction, and the other end 12*b* is the downstream end in the ink flow direction.

In this embodiment, the communicating portion 310 is located on the upper side of the storage chamber S, and the communicating portion 320 is located on the lower side of the storage chamber S. Referring to FIG. 3, letting H be the height from the bottom wall (lower surface) of the storage chamber S to the upper wall (upper surface), H1 be the height to the communicating portion 310, and H2 be the height to the communicating portion 320, $$H \geq H1 > H2 \geq 0$$

holds.

When H1 is made as large as possible, and H2 is made as small as possible, the ink storage amount in the sub-tank 12 can be increased. That is, when the communicating portion 310 is arranged near the upper surface of the storage chamber S, and the communicating portion 320 is arranged near the lower surface of the storage chamber, the ink storage amount can be increased.

For example, H1 is less than H by about 3 mm, and H2 is about 2 mm from the lower surface. Note that referring to FIG. 3, h represents the liquid surface height.

The pipe 230 is provided with an opening/closing unit 240. The opening/closing unit 240 is an on-off valve capable of opening/closing the pipe 230. The opening/closing unit 240 includes an electric actuator such as an electromagnetic solenoid, and performs an opening/closing operation under the control of the control circuit of the printing apparatus 1.

The sub-tank 12 is provided with a pump unit 250 that moves ink in the storage chamber. The pump unit 250 is, for example, a diaphragm pump. The pump unit 250 has an inner volume that communicates with the storage chamber S via an opening 350 provided in the bottom portion of the sub-tank 12. The ink can be caused to flow into the storage chamber S or flow out of the storage chamber S by changing the inner volume. The pump unit 250 includes, for example, a flexible member of rubber or the like that encloses the inner volume, and an electric actuator that deforms the flexible member, and performs a pumping operation under the control of the control circuit of the printing apparatus 1. The pump unit 250 may be provided in the ink supply channel outside the sub-tank 12, and need only be provided between the main tank 11 and the opening/closing unit 240.

The sub-tank 12 is provided with a detecting unit SR. The detecting unit SR can detect the liquid surface of ink in the storage chamber. In this embodiment, the detecting unit SR uses an electrode method but may employ an optical method. The detecting unit SR includes electrodes 330 and 340. The electrodes 330 and 340 are pin members vertically extending downward from the top of the storage chamber S. The lower end of the electrode 330 is located at a position higher than the lower end of the electrode 340 in accordance with the height of the liquid surface to be detected. The liquid surface of ink in the storage chamber S is detected by the electrically connected state between the electrodes 330 and 340.

For example, as shown in FIG. 3, let H3 be the height from the bottom surface of the storage chamber S to the lower end of the electrode 330. If the ink liquid surface height h is equal to or more than the height H3, the electrodes 330 and 340 are electrically connected via the ink. Hence, it can be determined that the ink liquid surface is at a predetermined height or more, and a predetermined amount of ink is stored in the storage chamber S.

On the other hand, if the ink liquid surface height h is lower than the height H3, no ink exists between the electrodes 330 and 340, and the electrodes 330 and 340 are electrically disconnected. Hence, it can be determined that the ink liquid surface height is less than the predetermined height, and a predetermined amount of ink is not stored in the storage chamber S. As described above, the ink liquid surface detecting position of the detecting unit SR is the lower end position of the electrode 330.

The height H3 of the lower end of the electrode 330 is equal to or less than the height H1 of the communicating portion 310. The height H3 is set to be smaller than the height H1 by, for example, 2 mm. This enables more reliable detection of the ink liquid surface in an ink filling state.

An ink filling operation will be described next. The filling operation is divided into a first filling operation of filling the range from the main tank 11 to the opening/closing unit 240 with ink and a second filling operation of filling the range from the opening/closing unit 240 to the printhead 10 with ink.

Figure 4A:
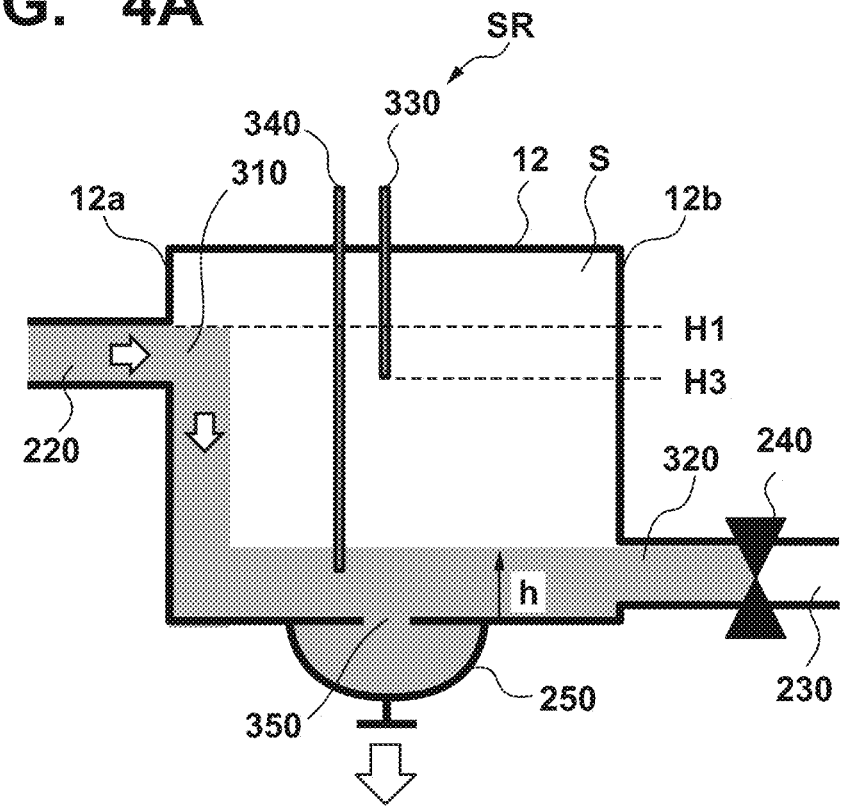
FIGS. 4A and 4B are explanatory views of an ink filling operation.
Figure 4B:
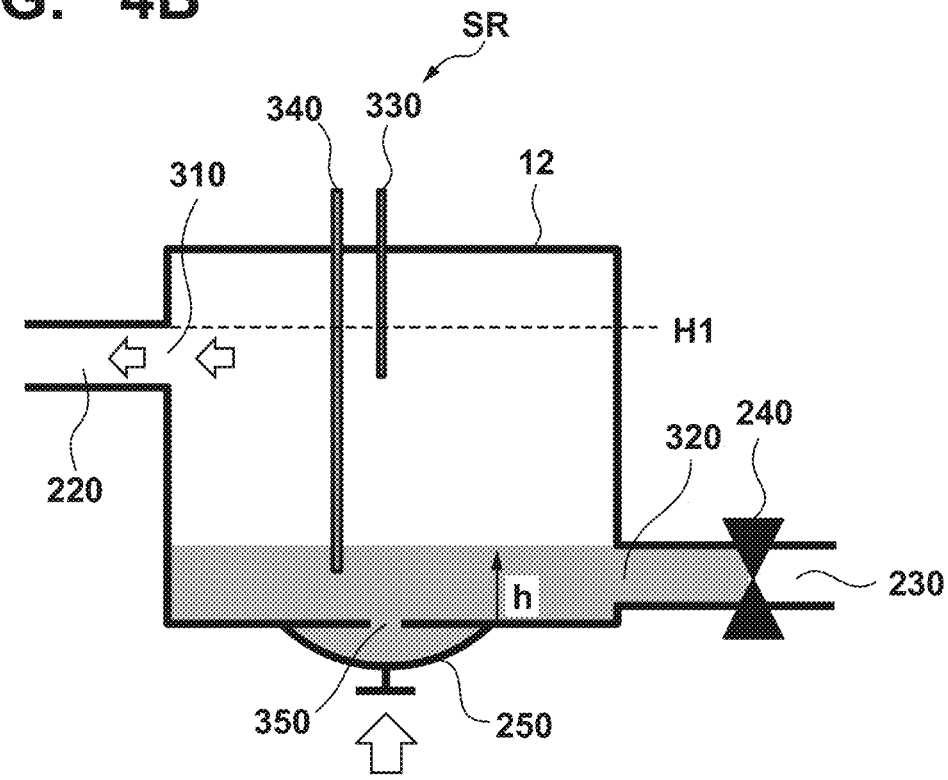

FIGS. 4A and 4B show the state of the sub-tank 12 in the first filling operation. The first filling operation is performed by changing the volume of the pump unit 250 in a state in which the opening/closing unit 240 is closed. When the volume in the pump unit 250 is increased, as shown in FIG. 4A, the pipe 220 and the storage chamber S change to a negative pressure state. As a result, it is possible to draw ink from the main tank 11 to the side of the storage chamber S until the pressure reaches an equilibrium state, and the ink is stored in the storage chamber S.

Next, when the volume in the pump unit 250 is reduced, as shown in FIG. 4B, air in the upper portion of the storage chamber S is pushed to the side of the main tank 11. This air is discharged from the above-described air vent 212. When this operation is repeated, gas-liquid exchange is performed between the air in the storage chamber S and the ink in the main tank 11, and finally, the ink liquid surface h rises up to the height H1 of the communicating portion 310. At this time, air remains in the space above the communicating portion 310 in the sub-tank 12. This aims at replacing the ink consumed near the electrode 330 with air without bubbles, as will be described later in detail.

The second filling operation is performed by the opening/closing operation of the opening/closing unit 240 and the suction operation of the printhead 10 by the recovery unit 6. First, the suction operation of the printhead 10 by the recovery unit 6 is performed in a state in which the opening/closing unit 240 is closed, thereby setting air in the pipe 230 and the printhead 10 in a reduced pressure state. When the opening/closing unit 240 is opened in this state, the ink on the side of the main tank 11 flows in at once, and the air under the reduced pressure is discharged from the printhead 10. The printhead 10 and the pipe 230 are thus filled with the ink.

Figure 5A:
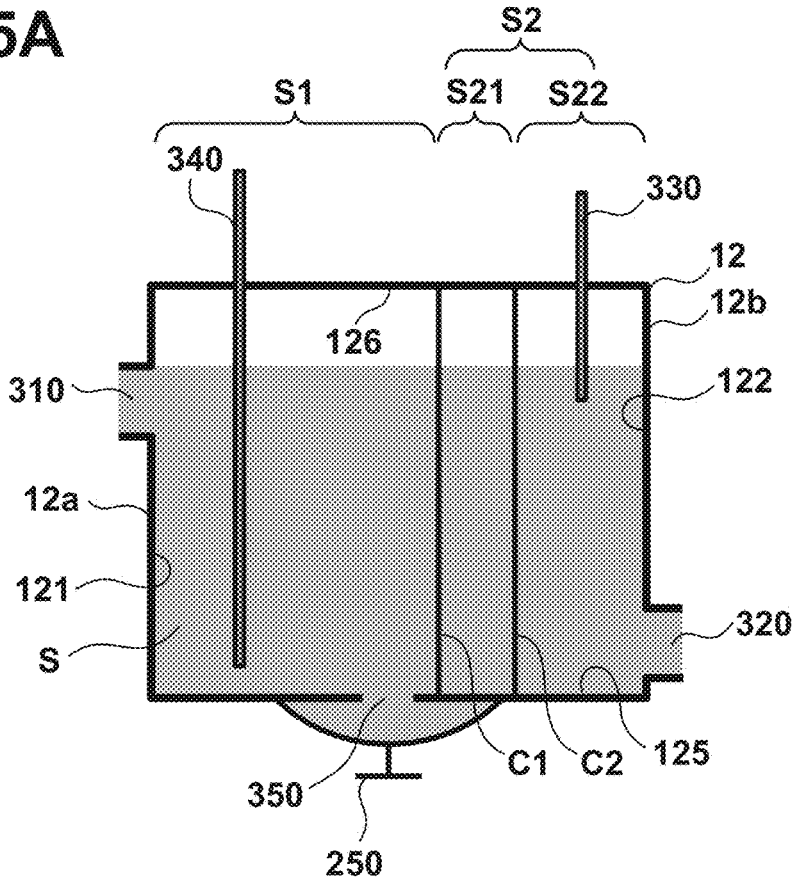
FIGS. 5A and 5B are explanatory views of a storage unit.
Figure 5B:
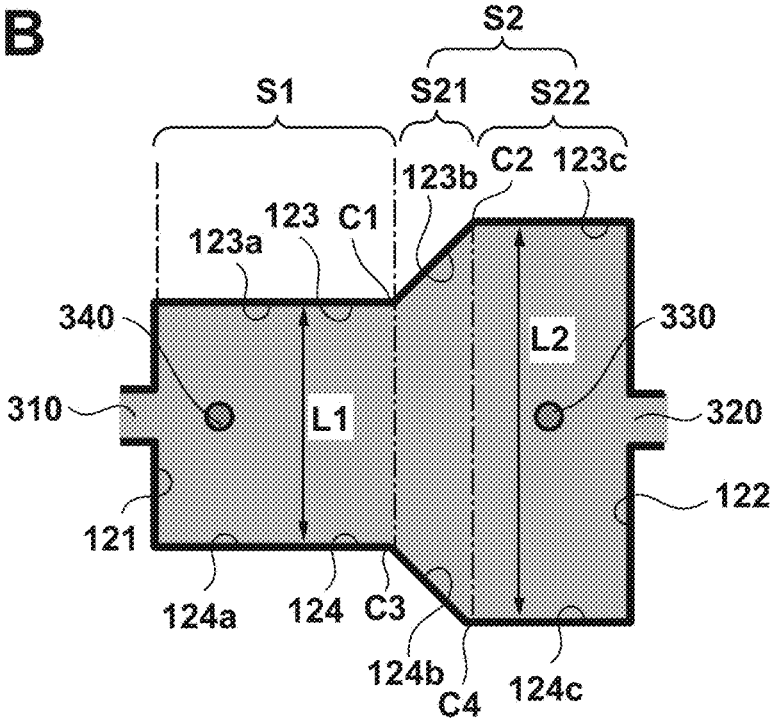

The structure of the storage chamber S will be described next. A description will be made with reference to FIGS. 5A and 5B. FIG. 5A is a longitudinal sectional view of the sub-tank 12, and FIG. 5B is a cross-sectional view of the sub-tank 12. The sub-tank 12 is a box-type tank including a plurality of inner walls 121 to 126 that delimit the storage chamber S.

Out of the plurality of inner walls 121 to 126, the inner walls 121 to 124 form the side surfaces of the storage chamber S. Hence, the inner walls 121 to 124 will sometimes be referred to as side walls 121 to 124. The inner wall 125 forms the bottom wall (lower surface) of the storage chamber S, and the inner wall 126 forms the upper wall (upper surface) of the storage chamber S. The electrodes 330 and 340 are fixed to the inner wall 126. The inner walls 125 and 126 are parallel.

Out of the side walls 121 to 124, the side walls 121 and 122 face each other. The side wall 121 is located on the side of the one end 12*a* (the side of the communicating portion 310), and the side wall 122 is located on the side of the other end 12*b* (the side of the communicating portion 320). The side walls 121 and 122 form a channel to make the ink flow from one communicating portion side to the other communicating portion side. In this embodiment, the side walls 121 and 122 are arranged facing each other so as to form a linear channel that makes the ink flow from the side of the communicating portion 310 to the side of the communicating portion 320. The side walls 123 and 124 extend, between the side walls 121 and 122, from the side of the one end 12*a* (the side of the communicating portion 310) to the side of the other end 12*b* (the side of the communicating portion 320).

In this embodiment, the communicating portion 310 is formed in the side wall 121. However, the communicating portion 310 may be formed in the inner wall 126 or the side wall 123 or 124. In this embodiment, the communicating portion 320 is formed in the side wall 122. However, the communicating portion 320 may be formed in the inner wall 125 or the side wall 123 or 124.

In this embodiment, the side walls 121 and 122 form single side surfaces and are parallel to each other. The direction between the side walls 121 and 122 will sometimes be referred to as a total length direction, and a direction perpendicular to the total length direction will sometimes be referred to as a widthwise direction. The widthwise direction is the direction between the side walls 123 and 124.

The side wall 123 forms a plurality of side surfaces. The side wall 123 includes a wall portion 123*a* on the side of the one end 12*a* (the side of the communicating portion 310), a wall portion 123*c* on the side of the other end 12*b* (the side of the communicating portion 320), and a wall portion 123*b* between the wall portions 123*a* and 123*c*. In this embodiment, the wall portions 123*a* and 123*c* form surfaces in a direction perpendicular to the side wall 121 or 122. The wall portion 123*b* forms a surface that tilts with respect to the wall portions 123*a* and 123*c*. A corner C1 that changes the plane direction of the wall portion is provided at the boundary between the wall portions 123*a* and 123*b*. The corner C1 is a corner that projects to the inside of the storage chamber S. A corner C2 that changes the plane direction of the wall portion is provided at the boundary between the wall portions 123*b* and 123*c*. The corner C2 is a corner that projects to the outside of the storage chamber S. The corners C1 and C2 are formed from the inner wall 125 to the inner wall 126.

The side wall 124 has a structure symmetric to the side wall 123 with respect to the center line of the storage chamber S in the widthwise direction. That is, the side wall 124 includes wall portions 124*a*, 124*b*, and 124*c* from the side of the one end 12*a* (the side of the communicating portion 310) to the side of the other end 12*b* (the side of the communicating portion 320). The wall portions 124*a* and 123*a* face each other and are parallel to each other. The wall portions 124*b* and 123*b* face each other but are not parallel to each other. The wall portions 124*c* and 123*c* face each other and are parallel to each other.

A corner C3 that changes the plane direction of the wall portion is provided at the boundary between the wall portions 124*a* and 124*b*. A corner C4 that changes the plane direction of the wall portion is provided at the boundary between the wall portions 124*b* and 124*c*. The corner C3 is a corner that projects to the inside of the storage chamber S. The corner C4 is a corner that projects to the outside of the storage chamber S. The corners C3 and C4 are formed from the inner wall 125 to the inner wall 126.

With the above-described structures of the side walls 123 and 124, the storage chamber S is virtually divided into spaces S1 and S2. The space S2 is located on the side of the other end 12*b* (the side of the communicating portion 320) with respect to the space S1. In this embodiment, the spaces S1 and S2 continue in the total length direction.

The space S1 is the space between the wall portions 123*a* and 124*a*. The distance (the width of the space S1) between the wall portions is L1 that is constant. In this embodiment, the space S2 is virtually divided into a partial space S21 and a partial space S22 arranged at a position closer to the side of the other end 12*b* (the side of the communicating portion 320) than the partial space S21. The partial spaces S21 and S22 continue in the total length direction. The space S1 and the partial space S21 continue in the total length direction.

The partial space S22 is the space between the wall portions 123*c* and 124*c*. The distance (the width of the partial space S22) between the wall portions is L2 that is constant. The distances L1 and L2 hold a relationship L1<L2. The partial space S21 is the space between the wall portions 123*b* and 124*b*. The distance (the width of the partial space S21) between the wall portions continuously changes within the range from L1 to L2. More specifically, the width of the partial space S21 gradually increases from the space S1 to the side of the other end 12*b* (the side of the communicating portion 320).

In this embodiment, the distance between the side walls 123 and 124 is thus set longer in the space S2 as a whole than in the space S1.

In this embodiment, the electrode 330 is arranged in the space S2, particularly, in the partial space S22. Hence, the ink liquid surface detecting position by the detecting unit SR is set in the space S2, particularly, in the partial space S22. By setting this detecting position, an ink liquid surface detection error caused by entrance of bubbles can be suppressed. The reason is as follows. Note that the electrode 340 can be arranged at any position because the influence on a detection error caused by the contact with bubbles is small. In this embodiment, the electrode 340 is arranged in the space S1, but the position is not limited to this.

Figure 6A:
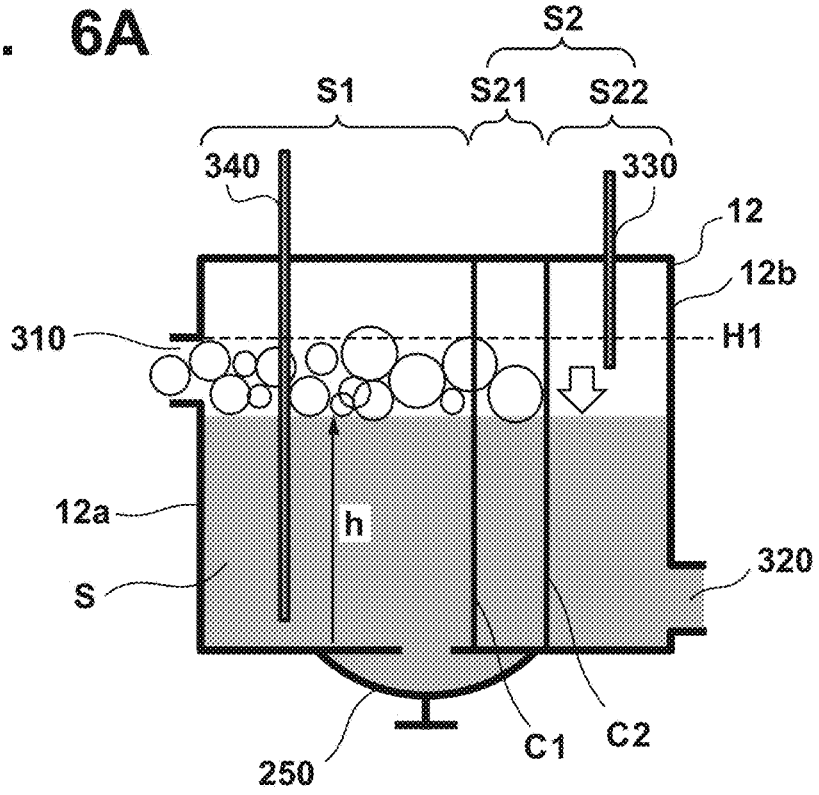
FIGS. 6A and 6B are explanatory views of the behavior of bubbles.
Figure 6B:
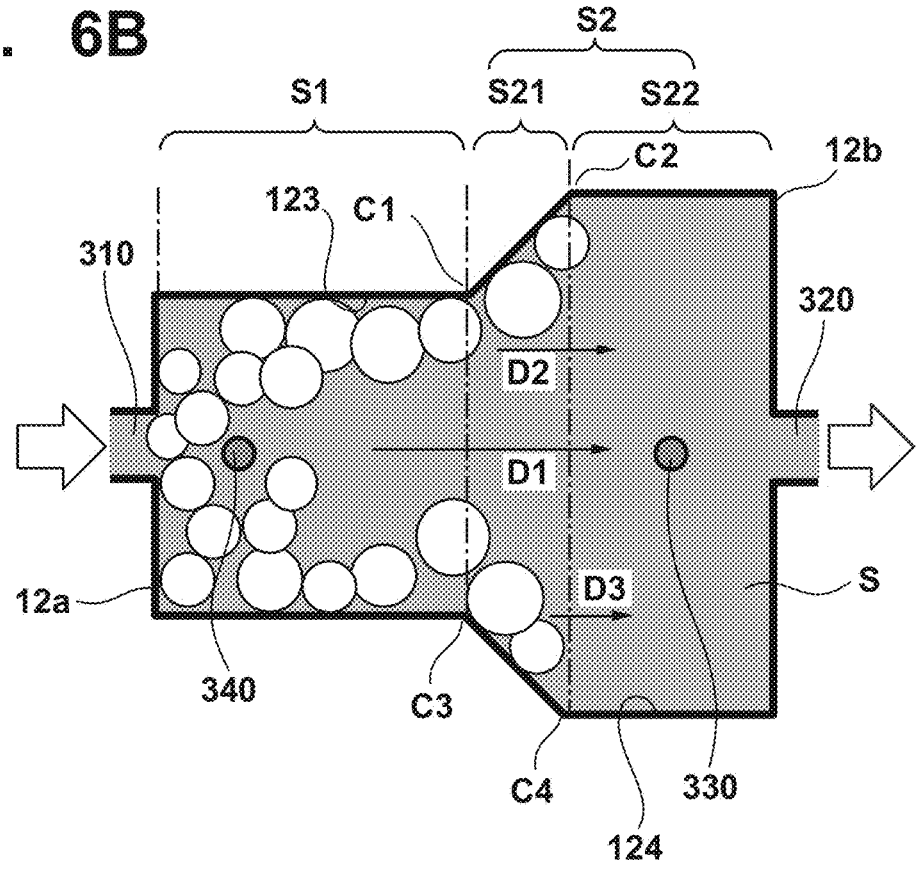

FIGS. 6A and 6B show the state in the sub-tank 12 when ink is consumed. FIG. 6A is a longitudinal sectional view of the sub-tank 12, and FIG. 6B is a cross-sectional view of the sub-tank 12. White circles represent bubbles.

If the ink in the main tank 11 runs out, the ink liquid surface height h in the storage chamber S gradually decreases from the height H1. At this time, air is taken from the communicating portion 310. The ink remaining in the ink supply channel flows into the storage chamber S as bubbles together with the air.

A surface tension acts on the gas-liquid interface of the bubbles, and a force that reduces the surface area acts. For this reason, the bubbles that have entered from the communicating portion 310 into the space S1 tend to adhere to the inner walls 121, 123, and 124. In addition, the bubbles tend to come into contact with each other near the inner walls 121, 123, and 124. The bubbles near the inner walls 121, 123, and 124 start entering the space S2 on the flow from the communicating portion 310 to the communicating portion 320. Since the space S2 is wider than the space S1, the flow rate of the ink tends to be relatively high near the center, as indicated by an arrow D1, and relatively low near the side walls 123 and 124, as indicated by arrows D2 and D3.

Hence, the bubbles tend to move relatively slowly along the side walls 123 and 124 while being thrust away to the sides of the side walls 123 and 124.

The corners C1 and C3 exist at the boundaries between the spaces S1 and S2. The bubbles that have reached the corners C1 and C3 tend to be stretched and increase the contact area with the side walls 123 and 124. If the volume of the bubbles is assumed to be unchanged, the surface area on the gas-liquid interface side becomes small when the bubbles pass the corners C1 and C3. The surface area of the gas-liquid interface increases in both the upstream and downstream sides of the corners C1 and C3. Hence, the bubbles tend to remain near the corners C1 and C3 where the surface area of the gas-liquid interface is small and are hard to peel off from the side walls 123 and 124.

This principle suppresses the movement of the bubbles to the downstream side of the corners C1 and C3, that is, to the side of the space S2. Additionally, as already described, since the space S2 is wider than the space S1, and the flow rate of the ink tends to be low near the side walls 123 and 124, as indicated by the arrows D2 and D3, the force to move the bubbles to the partial space S22 also becomes small.

In this embodiment, the corners C2 and C4 also exist at the boundaries between the partial spaces S21 and S22. The bubbles tend to remain near the corners C2 and C4, as in the corners C1 and C3, and are hard to peel off from the side walls 123 and 124. Note that when the angles of the corners C1 and C2 are defined as θ1 and θ2 shown in FIG. 7A, respectively, $$0° < \theta 1 \leq 90°, \text{ and}$$

$$0° < \theta 2 \leq 90°$$

can be set. The corners C3 and C4 are the same as the corners C1 and C2.

With the above-described function, entrance of bubbles into the partial space S22 is suppressed. Since the detecting position of the detecting unit SR is set in the partial space S22, the influence of bubbles on ink liquid surface detection can be reduced, and an ink liquid surface detection error can be suppressed. In this embodiment, the storage chamber S has no air vent. Hence, an ink liquid surface detection error can be suppressed irrespective of the presence/absence of an air vent.

In this embodiment, the electrode 330 is located at a position apart from the side walls 123 and 124, particularly, at the center in the widthwise direction between the side walls 123 and 124. It is therefore possible to reduce the possibility that the bubbles adhering to the side walls 123 and 124 adhere to the electrode 330. As for the position of the electrode 330, the partial space S22 is more advantageous than the partial space S21 from the viewpoint of preventing bubble adhesion. However, even if the electrode 330 is arranged in the partial space S21, the effect of preventing bubble adhesion can be attained to some extent.

Note that to replace the ink consumed in the partial space S22 with air without bubbles, it is effective to make the air quantity in the space S1 and the partial space S21 in the ink filling state equal to or more than the consumed ink amount.

Figure 7A:
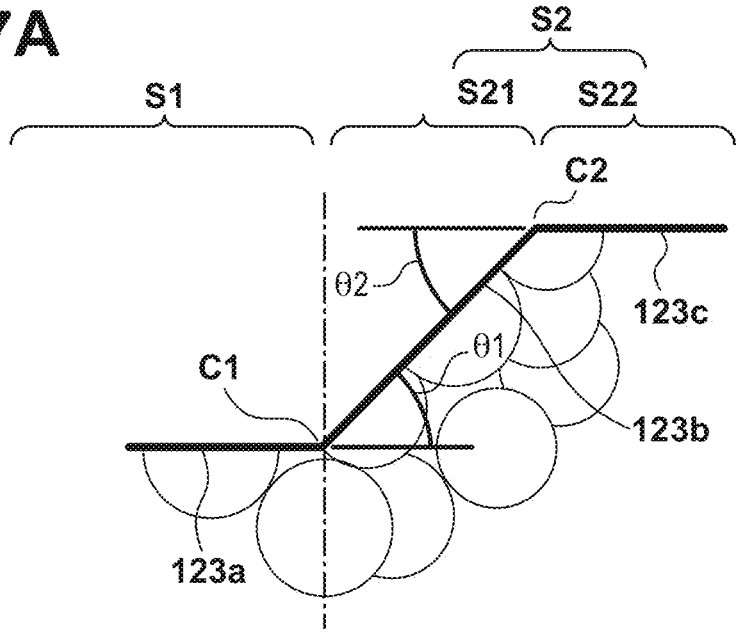
FIG. 7A is an explanatory view of corners.
Figure 7B:
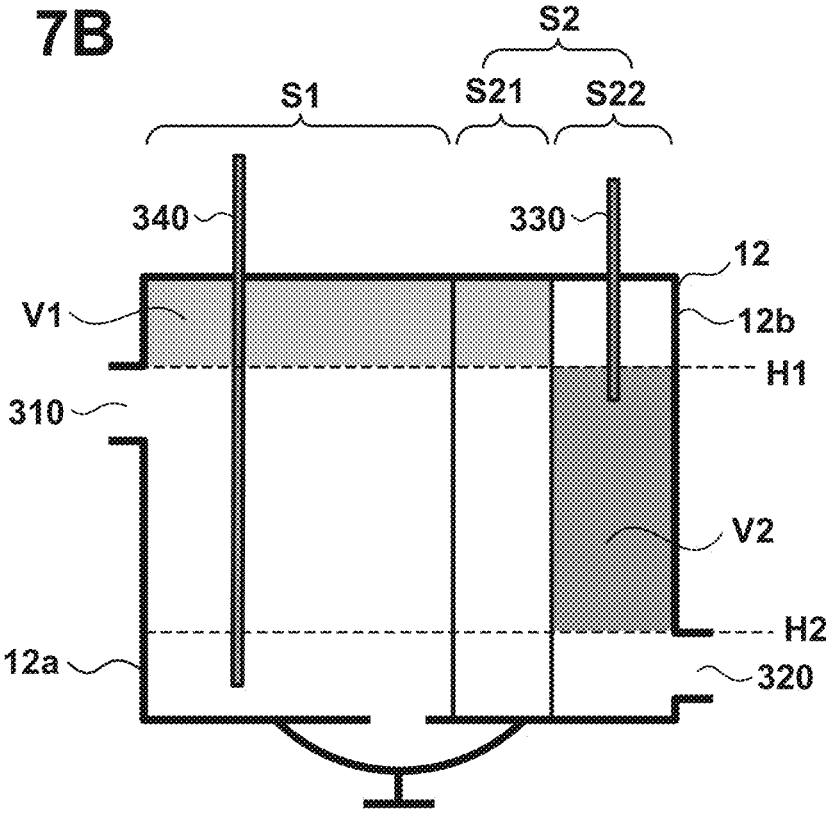
FIG. 7B is an explanatory view of the volume of the storage unit.

FIG. 7B shows the relationship between an air quantity and an ink amount in the storage chamber S. Let V1 be the air quantity in the space S1 and the partial space S21 in the ink filling state (liquid surface height H1). V1 is the volume within the range from the communicating portion 310 to the upper surface (inner wall 126) of the storage chamber S. Let V2 be the volume (consumed ink amount) within the range from the ink filling state (liquid surface height H1) to the height H2 out of the partial space S22. V2 is the volume within the range from the communicating portion 320 to the communicating portion 310. When $$V1 \geq V2$$

holds, the air that replaces the ink can be air without bubbles.

Note that if it is determined that the main tank 11 is exchanged after the ink in the storage chamber S is consumed, the above-described first filling operation can be executed. By the first filling operation, the air and bubbles in the storage chamber S are transferred to the side of the main tank 11. The second filling operation is the same as the above-described operation.

<Second Embodiment>

Even if bubbles are mixed, they do not affect the detection of the liquid surface height unless they come into contact with an electrode 330. On the other hand, a space S1 is narrower than a space S2. The ink storage amount can be improved by increasing the width of the space S1.

Figure 8A:
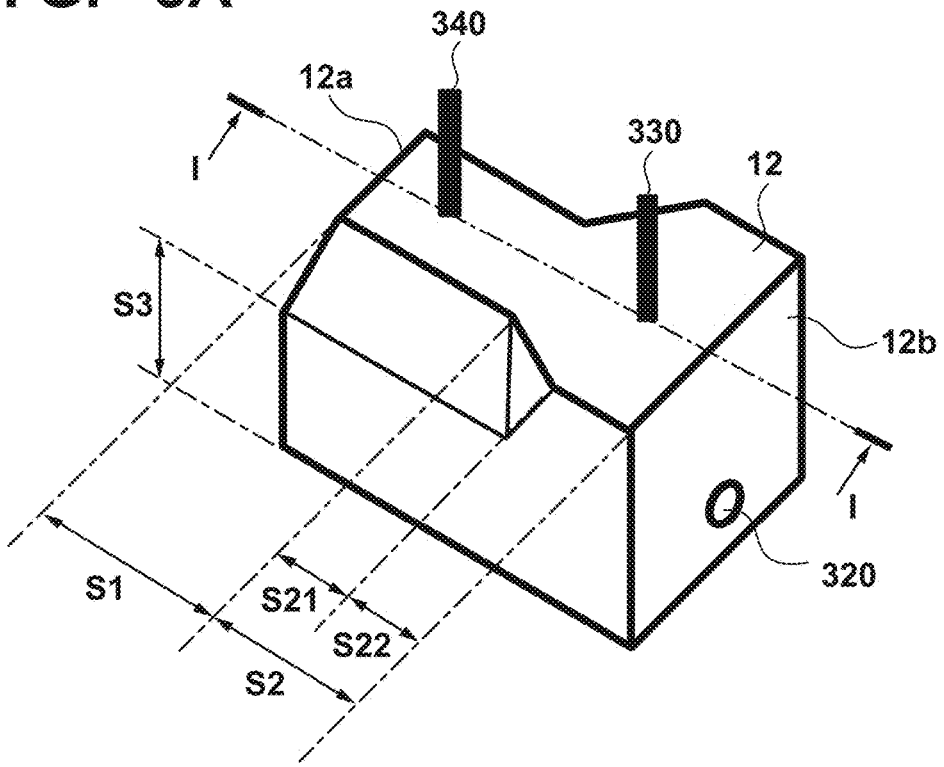
FIG. 8A is a perspective view of a storage unit according to another embodiment.
Figure 8B:
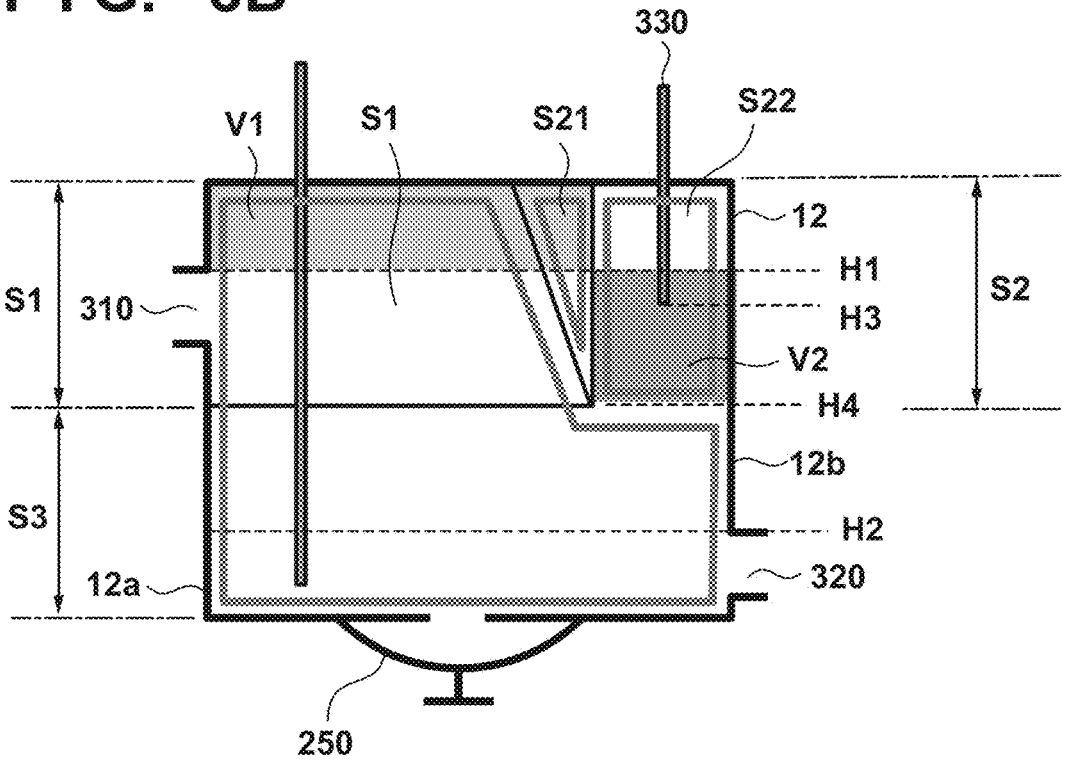
FIG. 8B is an explanatory view of the volume of the storage unit according to another embodiment.

FIG. 8A is a perspective view of a sub-tank 12 according to this embodiment. FIG. 8B is a sectional view taken along a line I-I in FIG. 8A. The same reference numerals as in the first embodiment denote components corresponding to those of the first embodiment, and a description thereof will be omitted. Different components will be explained.

In this embodiment, the clearance between the lower portions of the wall portions 123*a* and 124*a* according to the first embodiment is increased and made equal with the clearance between the wall portions 123*c* and 124*c*. The width is narrow only between the upper portions of the wall portions 123*a* and 124*a*.

The internal space of a storage chamber S is roughly virtually divided into the spaces S1 and S2 on the upper side and a space S3 on the lower side. A height H4 of the lower end of the space S2 is set between heights H2 and H3.

The space S3 is a region where bubbles can be mixed, like the space S1, and more bubbles can be accepted. However, according to the same principle as in the first embodiment, it is possible to suppress the entrance of bubbles into a partial space S22.

In addition, since a volume V2 of the ink amount in the partial space S22 is smaller than in the first embodiment, an air quantity V1 in the space S1 and a partial space S21 in the ink filling state can be decreased. As a result, the sub-tank 12 can be made compact.

<Third Embodiment>

Figure 9A:
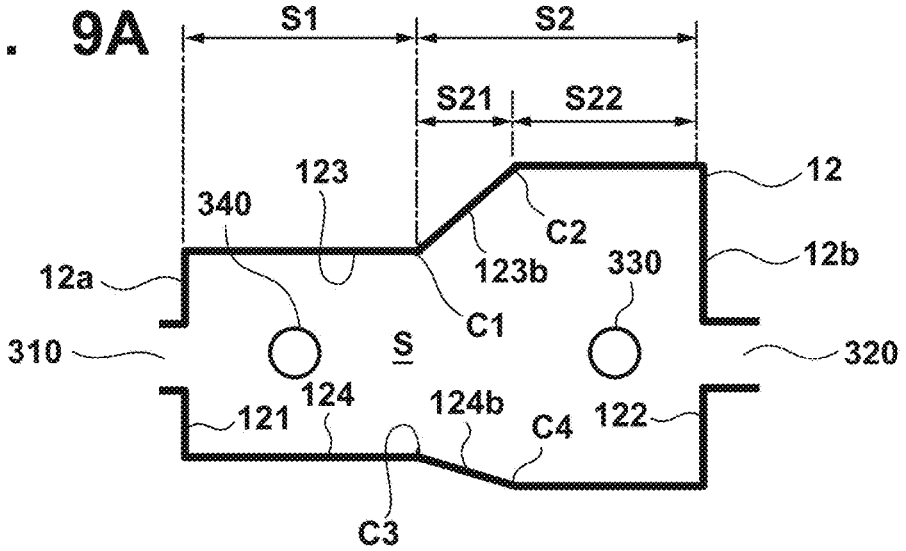
FIGS. 9A to 9C are explanatory views of a storage unit according to another embodiment.

In the first embodiment, the side walls 123 and 124 are symmetric with respect to the center line of the storage chamber S in the widthwise direction. However, they may be asymmetric. FIG. 9A shows an example. In the example of FIG. 9A, the tilt angle of a wall portion 123*b* and the tilt angle of a wall portion 124*b* are different in the longitudinal direction. In this arrangement, although the effect of preventing bubble movement to a space S2 may change between side walls 123 and 124, the movement preventing effect can be attained to some extent as a whole.

Figure 9B:
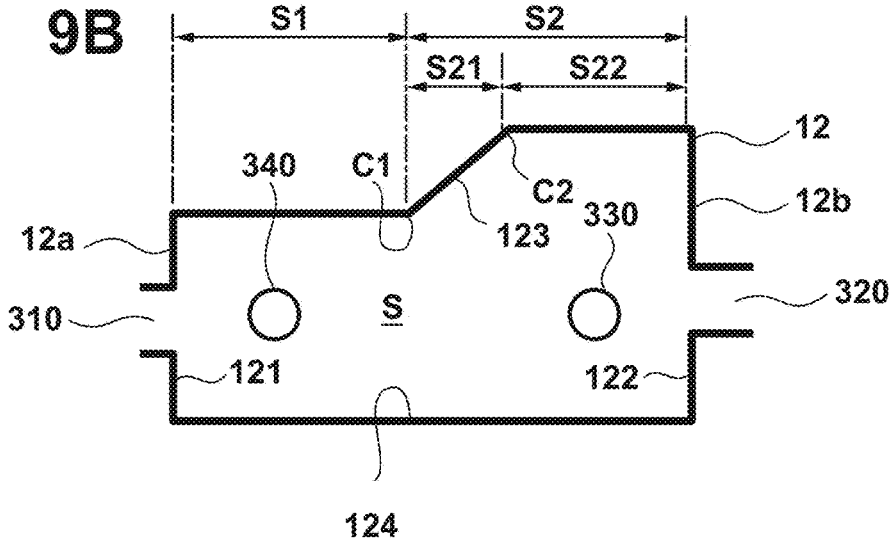
Figure 9C:
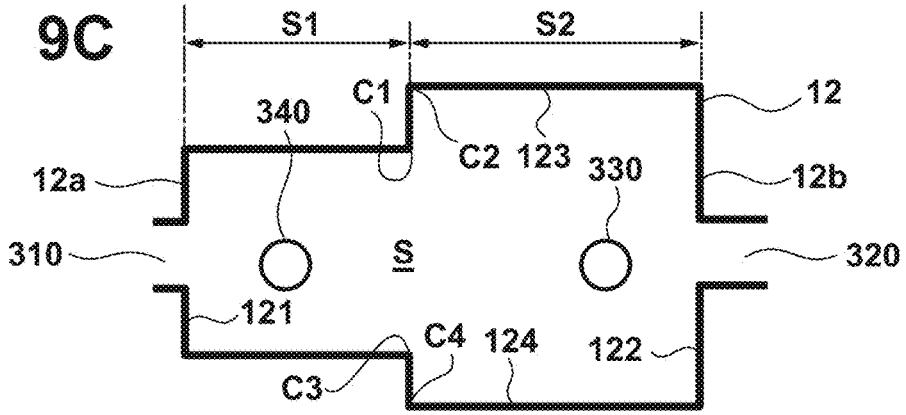

In the first embodiment, both of the side walls 123 and 124 are formed from a plurality of side surfaces. However, only one side wall may be formed from a plurality of side surfaces. FIG. 9B shows an example. In the example of FIG. 9B, the side wall 124 is formed as a single side surface. In this arrangement, although the effect of preventing bubble movement to the space S2 may be absent on the side of the side wall 124, the movement preventing effect can be attained to some extent as a whole.

Figure 10A:
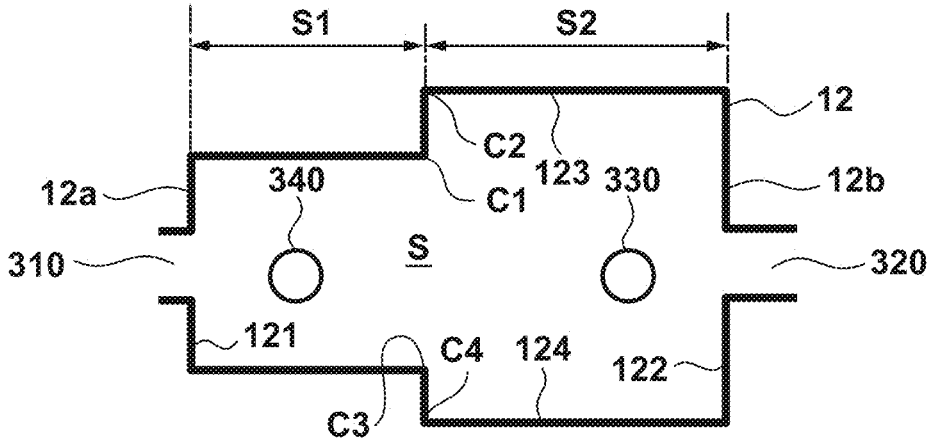
FIGS. 10A and 10B are explanatory views of a storage unit according to another embodiment.

In the first embodiment, $0° < \theta 1 \leq 90°$ and $0° < \theta 2 \leq 90°$ have been exemplified as θ1 and θ2 in FIG. 7A. FIG. 10A shows a case in which θ1 and θ2 are 90°. In the example of FIG. 10A, the space S2 is not divided into partial spaces S21 and S22. In this arrangement as well, the effect of preventing bubble movement to the space S2 can be obtained. Although the arrangement is not limited to the example of FIG. 10A, the closer the position of an electrode 330 is to the side of the other end 12*b*, the more the effect of preventing contact with bubbles can be improved. In the example of FIG. 10A, the effect of preventing contact with bubbles is provably improved by locating the electrode 330, for example, closer to the side of the other end 12*b* than the position half in the longitudinal direction out of the space S2.

<Fourth Embodiment>

Figure 10B:
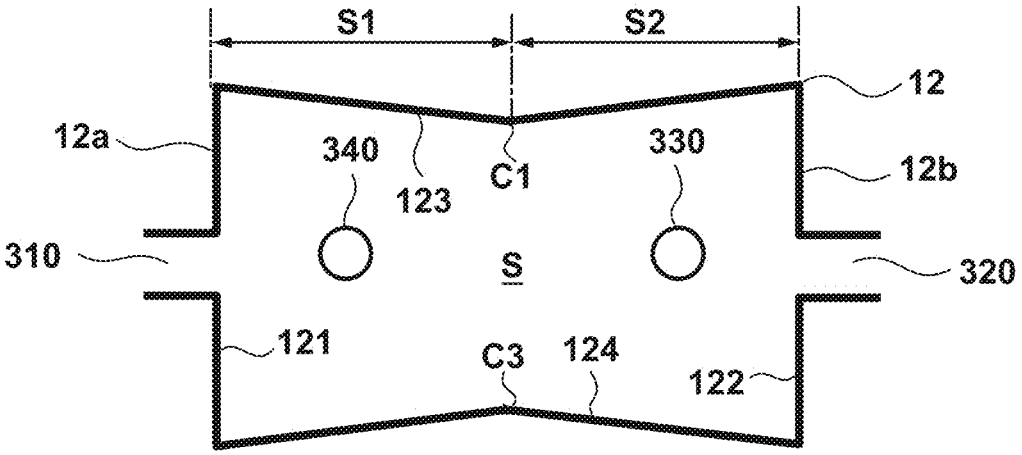

In the first embodiment, the space S2 is wider than the space S1. If a corner can be formed on a side wall, the effect of preventing bubble movement can be attained to some extent. FIG. 10B shows an example. In the example of FIG. 10B, the plane direction is changed between a wall portion of a side wall 123 on the side of one end 12*a* (the side of a communicating portion 310) and a wall portion on the side of the other end 12*b* (the side of a communicating portion 320), thereby forming a corner C1. Similarly, the plane direction is changed between a wall portion of a side wall 124 on the side of the one end 12*a* (the side of the communicating portion 310) and a wall portion on the side of the other end 12*b* (the side of the communicating portion 320), thereby forming a corner C3. The space on the side of the one end 12*a* (the side of the communicating portion 310) with respect to the corners C1 and C3 forms the space S1, and the space on the side of the other end 12*b* (the side of the communicating portion 320) with respect to the corners C1 and C3 forms the space S2.

In this embodiment as well, the effect of preventing bubble movement to the space S2 can be obtained by the corners C1 and C3 according to the same principle as the corners C1 and C3 of the first embodiment.

<Fifth Embodiment>

Figure 11A:
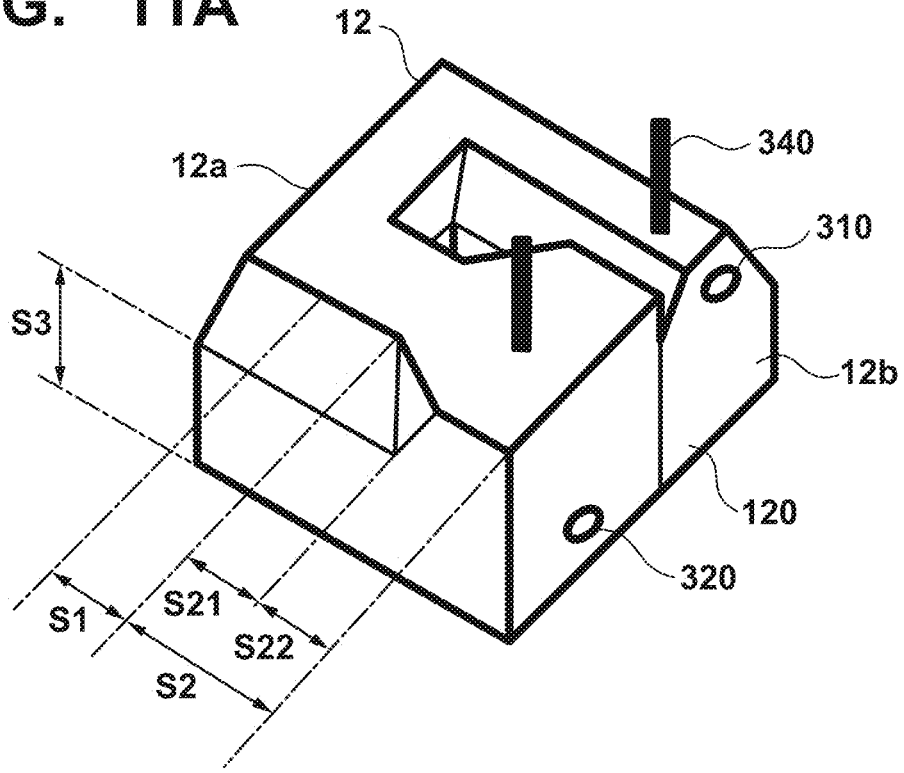
FIGS. 11A and 11B are explanatory views of a storage unit according to another embodiment.
Figure 11B:
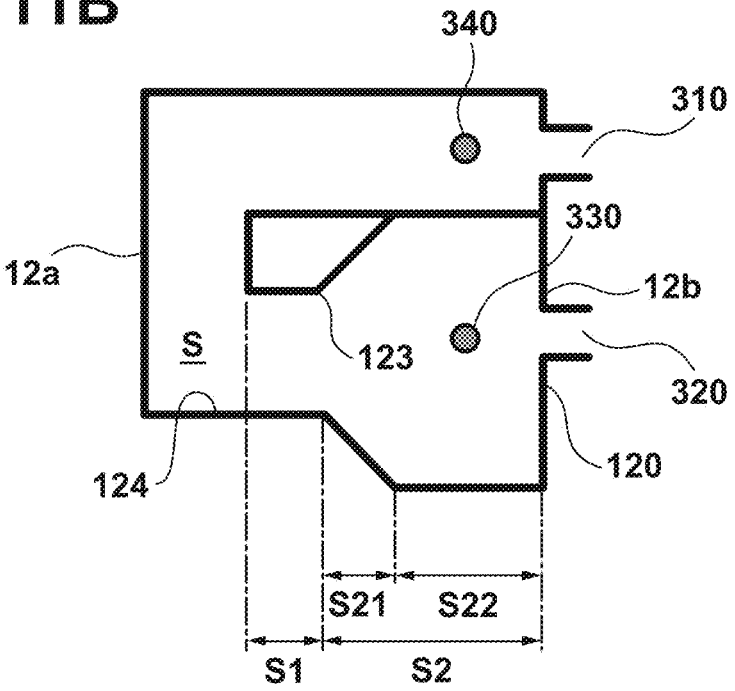

In the first embodiment, the side walls 121 and 122 are arranged so as to form a linear channel that makes the ink flow from the side of the communicating portion 310 to the side of the communicating portion 320. However, the side walls may be arranged so as to form a bent channel. This can be increase the storage amount in a storage chamber S in a narrow space. FIGS. 11A and 11B show an example. FIG. 11A is a perspective view of a storage unit 12 according to this embodiment. FIG. 11B is a horizontal sectional view of the storage unit 12 according to this embodiment.

In the example of FIGS. 11A and 11B, the ink channel from the side of a communicating portion 310 to the side of a communicating portion 320 has a U shape. However, this channel may have, for example, a bent shape other than the U shape.

The storage unit 12 includes a side wall 120 on the side of the other end 12*b*, and both of the communicating portions 310 and 320 are provided in the side wall 120 while being apart from each other in the vertical and horizontal directions. To form the U-shaped channel, a side wall 123 is located outside the channel, and a side wall 124 is located inside the channel. The side wall 123 extends from one end of the side wall 120 to one end 12*a*, bends at an angle, extends to the side wall 120, and is connected to the other end of the side wall 120. The side wall 124 extends from the center of the side wall 120 to the one end 12*a*, bends at an angle, extends to the side wall 120, and is connected to the center of the side wall 120.

The structure of the internal space of the storage chamber S on the periphery of the communicating portion 320 is the same as in the second embodiment, and is roughly divided into spaces S1 and S2 on the upper side and a space S3 on the lower side. The space from the communicating portion 310 to the space S1 can conceptually be regarded as part of the space S1 or part of the space S3, or as another space.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2015-110807, filed May 29, 2015, which is hereby incorporated by reference herein in its entirety.

What is claimed is:

1. A printing apparatus comprising:

a printhead;

a storage chamber configured to store ink to be supplied to the printhead;

a first communicating portion through which an ink tank attached to the printing apparatus is capable of communicating with the storage chamber;

a second communicating portion through which the printhead is capable of communicating with the storage chamber; and a first side wall and a second side wall arranged facing each other so as to form a channel in which ink flows in an ink supplying direction from a side of the first communicating portion to a side of the second communicating portion in the storage chamber, wherein the storage chamber includes a first space, and a second space located closer to the side of the second communicating portion than the first space, in which a distance between the first side wall and the second side wall in a horizontal direction intersecting with the ink supplying direction is set larger than in the first space, and the printing apparatus further comprises a detecting unit arranged in the second space and capable of detecting a liquid surface of ink in the storage chamber.

2. The apparatus according to claim 1, wherein each of the first side wall and the second side wall includes a corner at which a plane direction changes at a boundary between the first space and the second space.

3. The apparatus according to claim 1, wherein the storage chamber includes a third space, and the third space is located on a lower side of the first space and the second space in a vertical direction, in which the distance is set larger than in the first space.

4. The apparatus according to claim 1, wherein the second space includes:

a first partial space continuous to the first space;

a second partial space continuous to the first partial space and located on the side of the second communicating portion, the first partial space is a space in which the distance continuously changes, and the detecting unit is arranged in the second partial space.

5. The apparatus according to claim 4, wherein the second partial space is a space in which the distance is constant.

6. The apparatus according to claim 5, wherein each of the first side wall and the second side wall includes a first corner at which a plane direction changes at a boundary between the first space and the first partial space, and each of the first side wall and the second side wall includes a second corner at which the plane direction changes at a boundary between the first partial space and the second partial space.

7. The apparatus according to claim 4, further comprising:

a third side wall provided with the first communicating portion; and a fourth side wall provided with the second communicating portion and facing the third side wall, wherein the first side wall and the second side wall extend between the third side wall and the fourth side wall such that the channel obtains a linear shape.

8. The apparatus according to claim 4, further comprising a third side wall provided with the first communicating portion and the second communicating portion, wherein the first side wall is located outside the channel, and the second side wall is located inside the channel such that the channel obtains a U shape.

9. The apparatus according to claim 7, wherein the first communicating portion is arranged on a side of an upper surface of the storage chamber, the second communicating portion is arranged on a side of a lower surface of the storage chamber, and a volume within a range from the first communicating portion to the upper surface out of the first space and the first partial space is larger than a volume within a range from the second communicating portion to the first communicating portion out of the second partial space.

10. The apparatus according to claim 8, wherein the first communicating portion is arranged on a side of an upper surface of the storage chamber, the second communicating portion is arranged on a side of a lower surface of the storage chamber, and a volume within a range from the first communicating portion to the upper surface out of the first space and the first partial space is larger than a volume within a range from the second communicating portion to the first communicating portion out of the second partial space.

11. The apparatus according to claim 1, wherein the detecting unit comprises:

a first electrode arranged in the storage chamber and extending in a vertical direction; and a second electrode arranged in the storage chamber and extending in a vertical direction, a lower end of the first electrode is located at a position higher than a lower end of the second electrode in accordance with a height of the liquid surface to be detected, and a detecting position of the detecting unit is set at the lower end position of the first electrode.

12. The apparatus according to claim 11, wherein the first electrode is arranged at a position apart from the first side wall and the second side wall.

13. The apparatus according to claim 11, wherein the first electrode is arranged at a center between the first side wall and the second side wall.

14. The apparatus according to claim 1, wherein the storage chamber does not include an air vent.

15. The apparatus according to claim 1, further comprising a pump configured to move ink in the storage chamber.

16. The apparatus according to claim 1, further comprising, in an ink supply channel between the printhead and the second communicating portion, an opening/closing unit configured to open/close the ink supply channel.

17. A printing apparatus comprising:

a printhead;

a storage chamber configured to store ink to be supplied to the printhead;

a first communicating portion through which an ink tank attached to the printing apparatus is capable of communicating with the storage chamber;

a second communicating portion through which the printhead is capable of communicating with the storage chamber; and a first side wall and a second side wall arranged facing each other so as to form a channel in which ink flows from a side of the first communicating portion to a side of the second communicating portion in the storage chamber, wherein the storage chamber includes a first space, and a second space located closer to the side of the second communicating portion than the first space, each of the first side wall and the second side wall includes a corner at which a plane direction changes at a boundary between the first space and the second space, and the printing apparatus further comprises a detecting unit arranged in the second space and capable of detecting a liquid surface of the ink in the storage chamber.

18. A printing apparatus comprising:

a storage chamber configured to temporarily store ink supplied from an ink tank; and a printhead configured to discharge ink supplied from the storage chamber;

wherein the storage chamber includes:

a first space defined by first and second wall members which are separated from each other by a first distance in a horizontal direction intersecting with an ink supplying direction; and a second space arranged at a downstream side of the first space in the ink supplying direction and defined by third and fourth wall members which are separated from each other by a second distance in the horizontal direction, wherein the second distance is larger than the first distance, and wherein a detecting unit is arranged in the second space and capable of detecting a liquid surface of ink in the storage chamber.

19. The apparatus according to claim 18, wherein the detecting unit comprises two electrodes arranged in the storage chamber and extending in a vertical direction;

wherein one electrode is positioned in the second space, and wherein the other electrode is positioned in the first space.

* * * * *